United States Patent [19]

Kepler et al.

[11] Patent Number: 4,726,279

[45] Date of Patent: Feb. 23, 1988

[54] WAKE STABILIZED SUPERSONIC COMBUSTION RAM CANNON

[75] Inventors: Charles E. Kepler, Manchester; Raymond L. Deblois, Tolland; Louis J. Spadaccini, Manchester, all of Conn.

[73] Assignee: United Technologies Corporation, Hartford, Conn.

[21] Appl. No.: 929,533

[22] Filed: Nov. 12, 1986

[51] Int. Cl.[4] ..... F41F 1/00; F42B 11/26

[52] U.S. Cl. ..... 89/8; 102/501

[58] Field of Search ..... 89/8, 7; 60/270.1; 102/501, 381; 244/3.1, 160

[56] References Cited

U.S. PATENT DOCUMENTS 3,253,511 5/1966 Zwicky ..... 89/8 X 4,428,293 1/1984 Botwin et al. ..... 102/381

OTHER PUBLICATIONS

Thomas H. Green, "Styles in Small Arms Projectiles an Analysis of the Development of Bullet Shapes—Old and New", Army Ordance, May-Jun. 1932, pp. 395-401.

P. J. Wilbur, "The Electrothermal Ramjet", J. Spacecraft, vol. 20, No. 6, Nov.-Dec. 1983, pp. 603-610.

Officers of the U.S. Navy, "Naval Ordance—A Text Book", The Lord Baltimore Press, 1921, pp. 82-83.

A. Hertzberg, "The Ram Accelerator: A New Chemical Method of Achieving Ultrahigh Velocities", 37th Meeting of Aeroballistic Range Assoc., Quebec, Canada 9/9-12/86.

*Primary Examiner*—Stephen C. Bentley

*Attorney, Agent, or Firm*—W. J. Sapone

[57] ABSTRACT

A supersonic combustion ram cannon (1) includes a conical projectile (8) with a flat base (9) which produces a subsonic wake (12) as it flies through a barrel (2). The projectile is configured to avoid a normal shock, relying instead on supersonic compression, combustion and gas expansion. The supersonic combustion of a fuel-oxidizer mixture around the tail of the subsonic wake, pressurizes the wake and drives the projectile forward. By utilizing wake stabilized supersonic combustion, the compression and combustion pressures can be matched to the limiting barrel working pressure, thereby providing for optimum thrust and maximum projectile acceleration.

9 Claims, 8 Drawing Figures

RAM CANNON

THERMALLY CHOKED RAM CANNON

SUPERSONIC COMBUSTION RAM CANNON

OBLIQUE DETONATION WAVE RAM CANNON

WAKE STABILIZED SUPERSONIC COMBUSTION RAM CANNON

TECHNICAL FIELD

This invention relates to ram cannons and more particularly to a supersonic combustion ram cannon which utilizes a subsonic projectile wake to stabilize the supersonic combustion process.

BACKGROUND ART

The ramjet principal of propulsion is well known in the art. During the flight of a ramjet powered vehicle, high velocity air enters a diffuser in the front of a ramjet engine which is shaped to slow the flowing air, thereby inducing compression of the airstream. The compression of the airstream generates a normal shock wave which slows the flowing air to subsonic velocities. As the air enters a combustion chamber, fuel is continuously injected into the combustion chamber and ignited, producing hot combustion gases. Forward vehicle thrust is provided by the ejection of the hot combustion gases through a discharge nozzle at a velocity greater than the flight speed. Since a ramjet relies on high air flow velocity through a diffuser rather than mechanical apparatus to achieve compression, ramjets require minimum flight speeds of approximately Mach 1–3 for efficient operation. Generally, chemical rocket motors or turbine type engines must be used to propel a ramjet-powered vehicle to such minimal flight speeds before ramjet propulsion is initiated.

Adapting the ramjet principal of propulsion to gun-fired projectiles significantly increases the range of artillery and the destructive potential of projectile discharging weapons. Conventional explosive propulsion generally accelerates a projectile to supersonic speeds between Mach 1.5–4.0. Ramjet propulsion extends the flight of a projectile by further accelerating such a projectile to hypersonic speeds (Mach 5.0 and above). Prior art weapons, utilizing the ramjet principle to boost projectile speed, have included various modified projectiles incorporating ramjet engines which initiate further acceleration after discharge from a conventional gun barrel. Such projectiles include an outer casing, an inner compression and combustion chamber, an integral fuel supply, and a discharge nozzle. U.S. Pat. No. 4,428,293 to Botwin et al discloses such a projectile which also includes variable thrust control of the projectile after discharge from a gun.

A ram cannon uses the ramjet principle to promote projectile acceleration before discharge from a gun barrel. By firing a projectile through a barrel section containing a fuel-oxidizer mixture, the projectile and barrel, in effect, become a ramjet engine with the barrel effectively forming the outer engine casing and the spacing between the projectile and barrel wall defining the compression and combustion chambers. In a subsonic combustion ram cannon (see FIG. 2*a*), a discharge nozzle is included which is defined by the annular spacing between the projectile tail and the barrel wall. As the projectile passes through the barrel, the premixed fuel-oxidizer mixture is compressed and ignited, generating hot combustion gases which expand rearwardly through the discharge nozzle, imparting forward thrust to the projectile.

A particular problem with subsonic combustion ram cannons is that such ramjet propulsion of a projectile within a gun barrel generates a rapid pressure build up during the projectile acceleration. A normal shock wave slows the flowing gas to subsonic velocities prior to combustion and induces a high pressure gradient directed to the barrel wall. It is at this point in the ramjet cycle that the peak pressure is encountered. Since the ram cannon design is limited by the barrel working pressure, a subsonic combustion ram cannon must be designed for the shock pressure. Consequently, the maximum muzzle velocity of the projectile is limited by the pressure rating of the barrel relative to the high pressure spike that occurs at the point of normal shock.

Another problem with subsonic combustion ram cannons involves the possibility of propagating a detonation wave ahead of the moving projectile into the unburned fuel-oxidizer mixture, resulting in a preignition of the fuel-oxidizer mixture, halting acceleration of the projectile.

Several alternatives have been proposed for alleviating this problem. Utilizing either a smaller diameter projectile or an oversized bore would increase the spacing between the barrel wall and projectile body, thereby decreasing the amount of fuel-oxidizer compression and moderating the normal shock pressure. However, such a loss in propulsion efficiency would also limit the projectile acceleration, thereby requiring a longer barrel to achieve a hypersonic muzzle velocity. Another proposed solution involves increasing the barrel working pressure by such methods as increasing barrel strength through increased wall thickness. However, while some weapons could incorporate such strengthened barrels, the costs and weights involved would be prohibitive.

Another alternative, disclosed in commonly assigned U.S. patent application Ser. No. 857,687 to Titus, titled "Ram Cannon Barrel", filed Apr. 31, 1986, involves the use of an outwardly flared barrel bore which provides added bore volume to offset the pressure increases. While useful in moderating the pressure buildup within the barrel, a major structural modification of the cannon barrel is required, and the maximum projectile acceleration is still structurally limited.

A variation of the subsonic combustion ram cannon utilizes a thermally choked combustion cycle (see FIG. 2*b*). In this cycle, the combustion takes place behind the projectile in the full barrel bore area. The combustion process therefore reaccelerates the gas flow to supersonic speed in the aft barrel area, thereby accelerating the projectile. While providing good performance at low speeds, the thrust drops off dramatically when the projectile approaches the detonation wave velocity of the propellant fuel-oxidizer mixture.

Utilizing supersonic combustion (see FIG. 2*c*) in a ram cannon has been investigated as a method of avoiding a normal shock and the concomitant high pressure peak. However, such supersonic combustion ram cannons include a tail section which confines the combustion area, leading to the build up of high pressure gradients in the combustion zone. Eventually, at high velocity, the supersonic combustion zone will narrow until an oblique detonation wave forms (see FIG. 2*d*), providing a very narrow reaction zone, similar to the normal shock wave. Since this pressure cannot exceed the barrel limiting pressure, the high pressures generated with the oblique detonation wave effectively limits the potential thrust.

Consequently, the search continues for a ram cannon capable of attaining high muzzle velocities with optimum propulsion efficiency and forward thrust, maximizing projectile acceleration.

DISCLOSURE OF INVENTION

It is an object of the present invention to moderate combustion pressures to acceptable levels in a ram cannon as a projectile is accelerated to hypersonic speeds therein.

It is a further object of the present invention to maximize propulsion efficiency and thereby maximize projectile acceleration.

These and other objects of the present invention are achieved by providing a ram cannon which includes a conical ram cannon projectile having an essentially flat base and tapering forwardly to a nose, developing a subsonic wake behind the projectile during flight which stabilizes and maintains supersonic combustion within the cannon barrel. In operation, the projectile is explosively accelerated in a cylindrically bored barrel section to supersonic speed. The projectile then enters the ram cannon by passing through a breech seal. As the projectile travels through the ram cannon barrel, a gaseous fuel-oxidizer mixture contained therein is compressed by the projectile nose and then combusted behind the flat base, without being decelerated through a normal shock wave. The fuel-oxidizer mixture is combusted at supersonic velocity and stabilized by an approximately conically shaped subsonic wake that trails the flat based projectile.

High pressures are moderated during the supersonic combustion as the combustion gases are spread over a relatively large diverging region rather than confined to a narrow region, with the combustion gases pressurizing the wake and thereby forwardly propelling the projectile. Since the maximum pressure is the limiting factor in the generation of projectile thrust, and the maximum pressure occurs with combustion rather than at a point of normal shock, utilization of wake stabilized supersonic combustion significantly increases the propulsion efficiency and thereby maximizes the muzzle velocities attainable in a ram cannon.

BEST MODE FOR CARRYING OUT THE INVENTION

Figure 1:
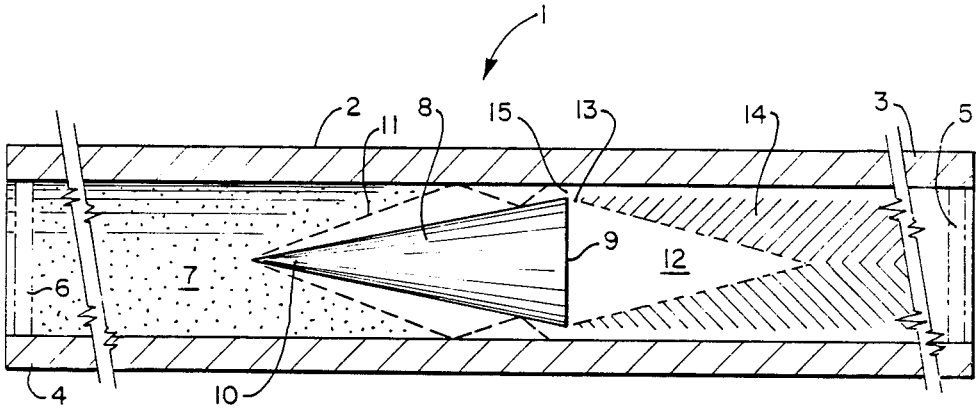
FIG. 1 is a schematic illustration of the wake stabilized supersonic combustion ram cannon of the present invention.
Figure 2A:
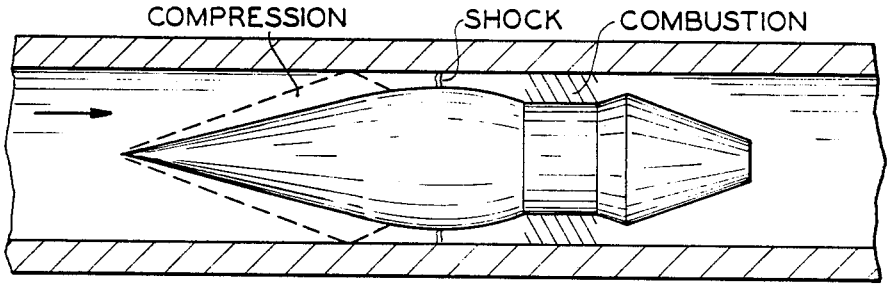
PRIOR ART FIG. 2a
FIG. 2*a* is a schematic illustration of a subsonic combustion ram cannon.
Figure 2B:
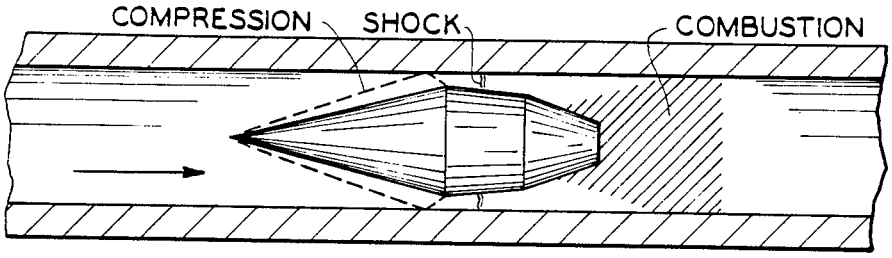
PRIOR ART FIG. 2b
FIG. 2*b* is a schematic illustration of a thermally choked ram cannon.
Figure 2C:
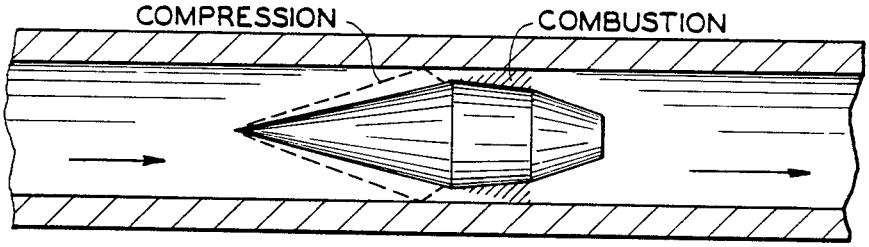
PRIOR ART FIG. 2c
FIG. 2*c* is a schematic illustration of a supersonic combustion ram cannon.
Figure 2D:
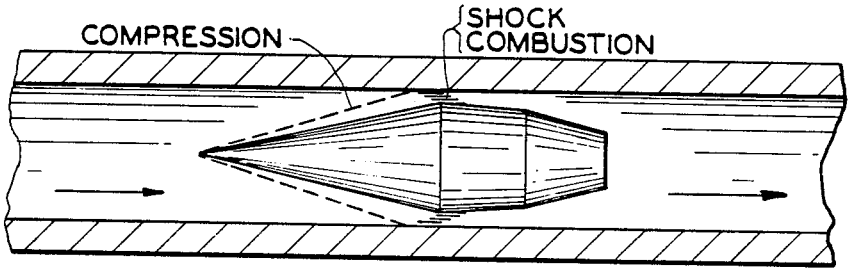
PRIOR ART FIG. 2d
FIG. 2*d* is a schematic illustration of an oblique detonation wave ram cannon.

Referring to FIG. 1, the wake stabilized supersonic combustion ram cannon 1 of the present invention has a barrel 2 with a breech end 3 and a muzzle end 4. The breech end 3 is provided with a breech seal 5 and the muzzle end 4 is provided with a muzzle seal 6. Such seals may comprise burst diaphragms which, when employed with suitable timing and actuation devices (not shown), are opened in flower-like fashion to allow uninterrupted travel of the projectile through the barrel. A fuel-oxidizer mixture 7 is contained within the sealed ram-cannon barrel 2. The fuel-oxidizer mixture usually includes a gaseous fuel, such as hydrogen, methane or ethane, and an oxidizer, such as oxygen, air or fluorine. Of course, other combustible gas mixtures may also be used. For illustrative purposes, the mixture 7 is stoichiometric methane and air under pressure, which may also be pre-heated to increase the speed of sound of the gas.

A ramjet engine is effectively formed with the barrel 2 comprising the outer engine casing, and a conical projectile 8 defining a ramjet type diffuser. The projectile 8 includes an essentially flat base 9 at the rear, tapering forwardly to a pointed nose 10. In operation, the projectile 8 is accelerated to supersonic velocitv in a starter cannon (not shown). The projectile 8 then enters the ram cannon barrel 2 by passing through the breech seal 5. The nose 10 compresses the fuel-oxidizer mixture 7, in a compression zone 11. External ignition sources, such as igniters imbedded in the barrel wall or in the projectile, may be used to initiate combustion.

Since the projectile has a flat base, a subsonic conical wake 12 develops immediately behind the projectile. The fuel-oxidizer mixture 7 is ignited at a point 13 slightly behind the base 9, just as the gas begins to expand from the point of maximum compression. The combusted mixture generates hot combustion gases 14 which expand supersonically along the diverging area around the tail of the wake, thereby pressurizing the subsonic wake 12. The stable wake moderates the combustion process and makes the base pressure comparable to the maximum pressure in the thrust cycle. Thus, the pressure propelling the projectile can be made comparable to the design pressure of the cannon barrel, thereby providing for maximum projectile acceleration. For pressurized upstream conditions, the base pressure can be made very high, providing a large accelerating thrust.

Figure 3:
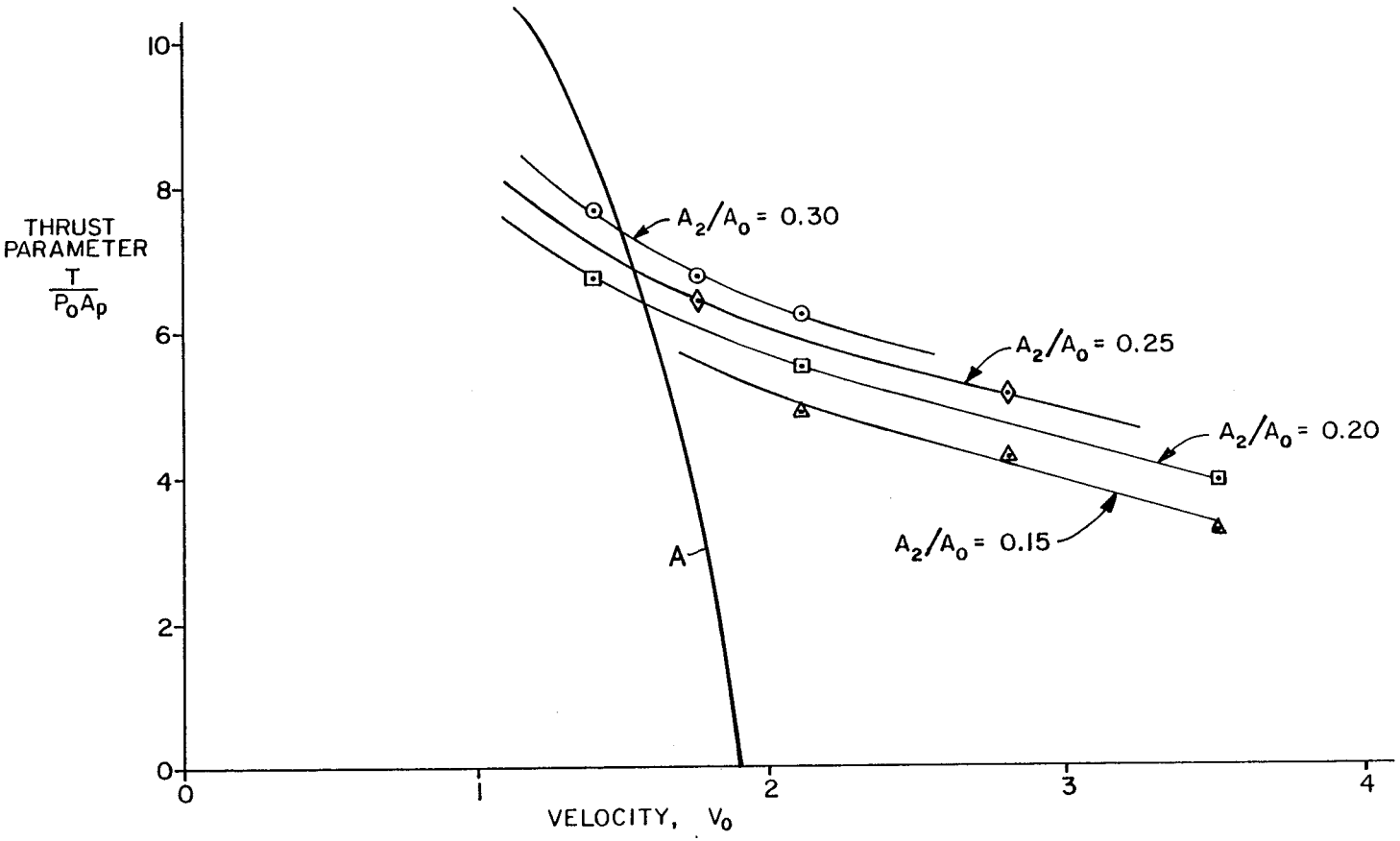
FIG. 3 is a graphical representation of the thrust parameter versus projectile velocity for a wake stabilized supersonic combustion ram cannon utilizing stoichiometric methane/air.

The theoretical thrust which could be produced by this wake stabilized supersonic combustion ram cannon is shown in FIG. 3 for four different aerodynamic contraction (throat area) ratios. The throat area ratio ($A_2/A_o$) is defined as the open throat area ($A_2$) at the point of maximum compression divided by the barrel open area ($A_o$). The thrust parameter is the calculated thrust force, T, divided by the reference force ($P_oA_p$), where $P_o$ is the gas pressure ahead of the projectile and $A_p$ is the maximum cross sectional area of the projectile. From this graph, it is seen that the thrust parameter gradually drops off with increasing velocity as opposed to the rapid decrease which occurs with the thermally choked combustion ram cannon (line A).

Figure 4:
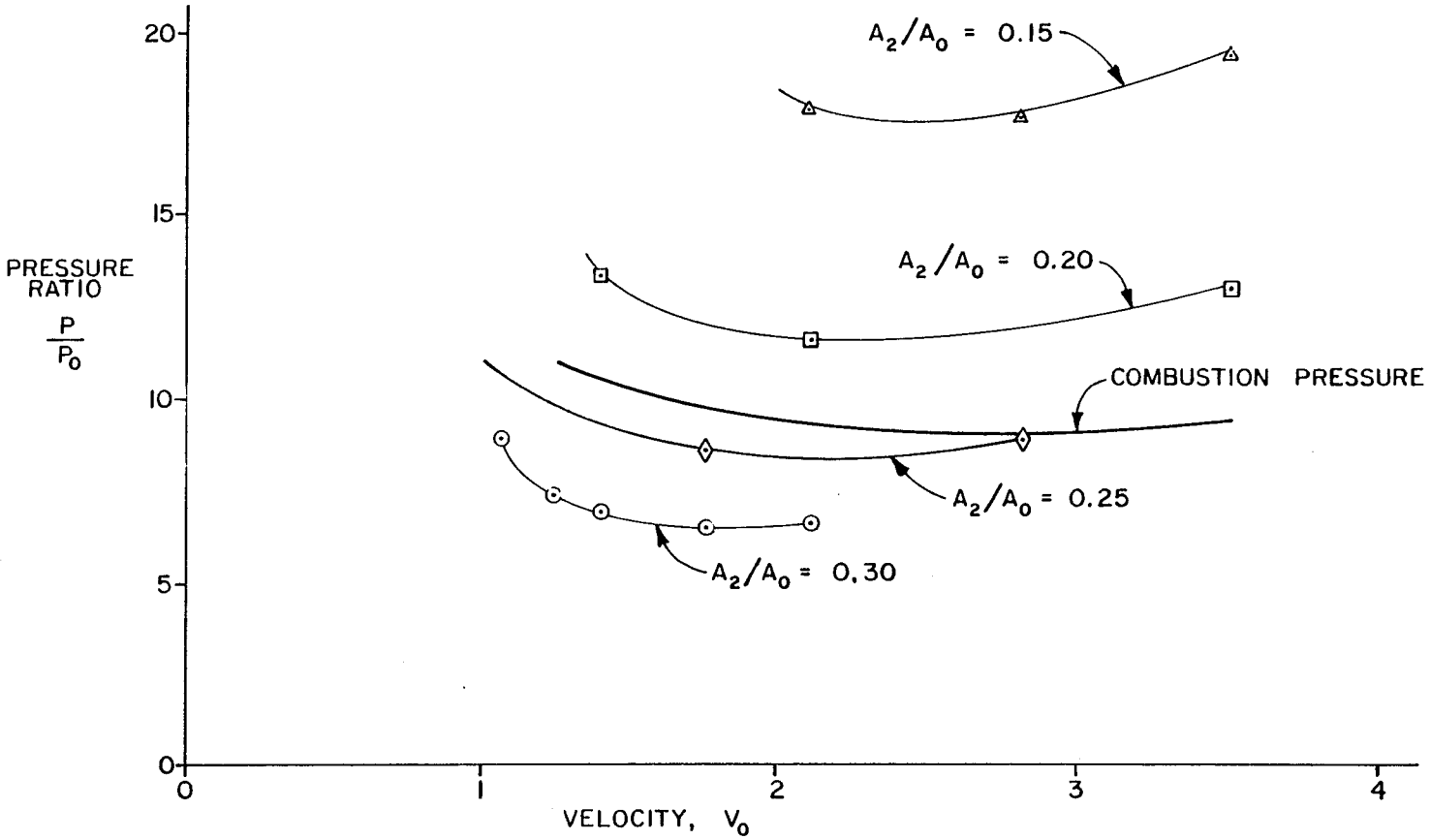
FIG. 4 is a graphical representation of the pressure ratio versus projectile velocity for a wake stabilized supersonic combustion ram cannon utilizing stoichiometric methane/air.

Referring to FIG. 4, the pressure ratio versus projectile velocity is shown. The pressure ratio compares the pressure at the point of maximum compression (P) to the upstream barrel pressure ($P_o$). The combustion pressure ratio, comparing combustion pressure to the upstream barrel pressure, is plotted along with the various ram compression ratios for various throat areas. Generally, throat area ratios of from 0.05–0.50 will provide acceptable results. However, from the graph, it can be seen that a preferred throat area ratio of 0.25 (i.e. a contraction ratio of 4 to 1) provides a ram compression ratio comparable to the combustion pressure ratio. Thus, no strong expansion or compression waves would be generated at the projectile base during compression and combustion. Therefore, the maximum pressure in the barrel would be the combustion pressure which could be made comparable to the barrel limiting pressure, thereby maximizing projectile thrust and acceleration.

Figure 5:
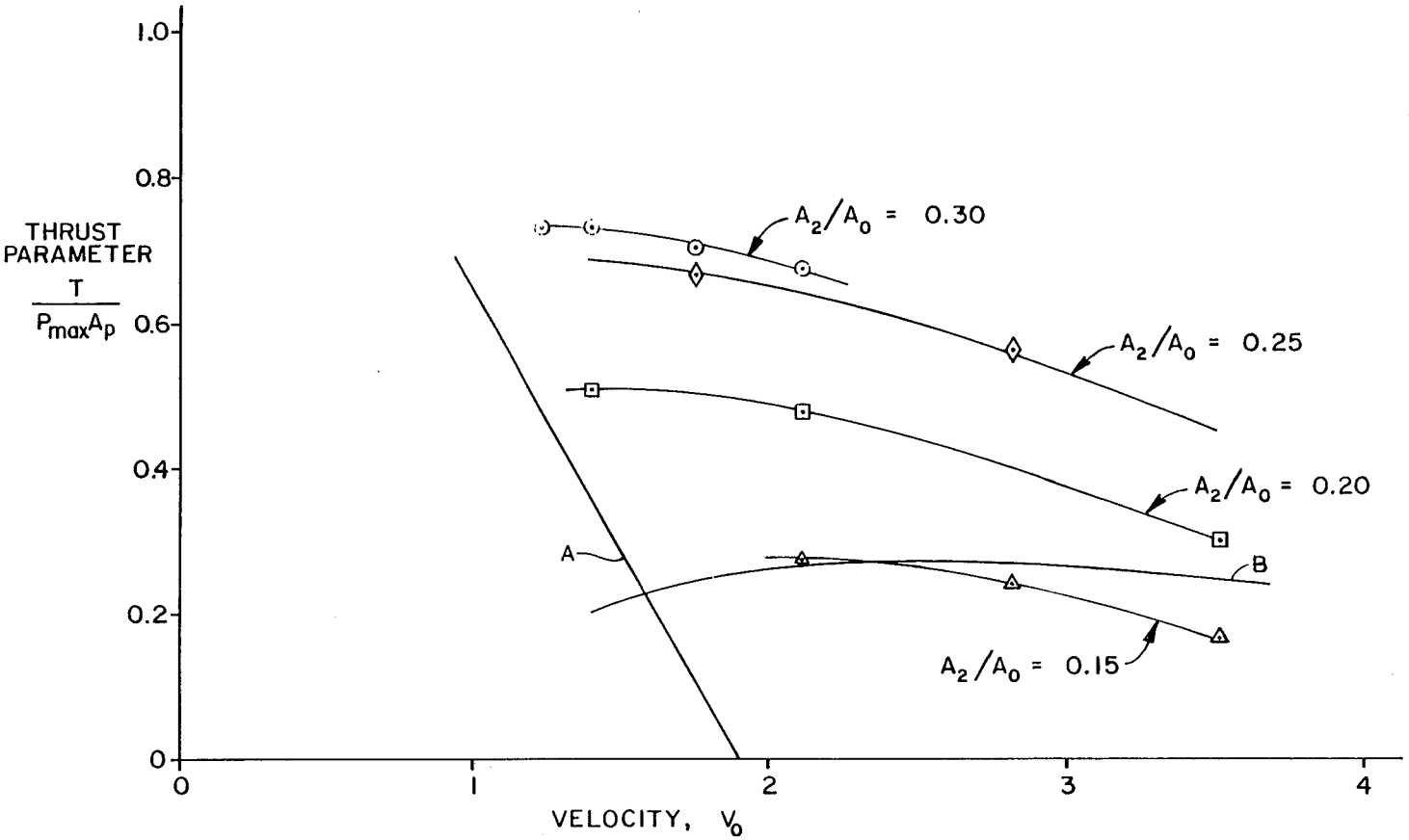
FIG. 5 is a graphical representation of the thrust parameter normalized using the maximum cycle barrel working pressure versus projectile velocity for a wake stabilized supersonic combustion ram cannon utilizing stoichiometric methane/air.

Referring to FIG. 5, the thrust parameter for the wake stabilized supersonic combustion ram cannon is shown for four throat area ratios, normalized by the reference force $P_{max}A_p$, where $P_{max}$ is a structurally limiting factor, such as the barrel working pressure. Also plotted are the values for two other types of ram cannons, the thermally choked ram cannon (line A) and the conventional supersonic combustion ram cannon (line B). From the graph, it is seen that the wake stabilized supersonic combustion ram cannon is superior to either of these other cycles in delivering higher thrust over a wide range of projectile velocities.

A significant advantage derived from utilizing a conical projectile in a ram cannon is the aerodynamic stability of the projectile geometry. With projectiles traveling at hypersonic speeds, flight stability is an important factor in determining the ultimate practicality of a ram cannon. The velocities are such that spin stabilization could not be used. However, a conical projectile, properly balanced to locate the center of gravity at the optimum location and utilizing a subsonic wake to pressurize the flat base, could provide stability at these high velocities.

The supersonic combustion ram cannon utilizing a wake stabilized configuration eliminates many of the problems which exist with other ram cannon designs. Utilizing supersonic combustion as the operating mode reduces the likelihood of detonating the fuel-oxidizer mixture when projectile velocities are below the detonation wave velocity of the mixture. By utilizing the subsonic wake to stabilize the combustion process, the base pressure generated is relatively insensitive to the rate of heat release in the supersonic stream surrounding the wake and the base pressure is therefore comparable to the maximum pressure in the thrust cycle, thus allowing matching of the propelling pressure to the barrel working pressure, thereby providing maximum projectile acceleration. In addition, this configuration reduces the likelihood of forming an oblique detonation wave.

It will be understood by those skilled in the art that this invention is applicable to any device incorporating ramjet propulsion of a projectile within a barrel. While the preferred embodiment of the present invention is described in relation to a conically shaped projectile hyperaccelerated in a fuel-oxidizer containing barrel, it will be understood by those skilled in the art that modifications in the bore taper, barrel type, sealing means, attaching means, bore surfacing, fuel-oxidizer mixture, projectile contour, throat area ratio or ignition source can be made without varving from the present invention.

Having thus described the invention, what is claimed is:

1. A wake stabilized supersonic combustion ram cannon in combination with a projectile, said cannon being of the type adapted for firing said projectile therethrough in accordance with ramjet principles, said cannon including a barrel having a bore extending therethrough, a breech end and a muzzle end, and means for sealing said barrel ends, wherein said projectile traveling through said barrel bore compresses a fuel-oxidizer mixture contained therein, gas generated by the ignition and combustion of said compressed mixture accelerating said projectile through said barrel, said projectile comprising an essentially conically shaped body with an essentially flat base, the projectile and barrel configured to provide supersonic compression and combustion of said fuel-oxidizer mixture, said concically shaped body producing a convergent subsonic wake as it travels through said barrel, said wake stabilizing the supersonic combustion process by spreading the combustion gases over the diverging region surrounding the wake, moderating pressures within the barrel, such that the compression and combustion pressures are essentially matchable to the barrel limiting pressure, thereby maximizing projectile acceleration.

2. The ram cannon of claim 1 wherein said projectile and barrel are configured to provide supersonic compression with an aerodynamic contraction ratio of from 0.05–0.50.

3. The ram cannon of claim 2 wherein said projectile are configured to provide supersonic compression with an aerodynamic contraction area ratio of 0.25.

4. The ram cannon of claim 1 wherein said fuel-oxidizer mixture comprises a mixture of a gaseous fuel and an oxidizer.

5. The ram cannon of claim 1 wherein said projectile has an optimally balanced center of gravity to provide stabilized flight at supersonic speeds.

6. A projectile for use in a ram cannon of the type adapted for firing a projectile therethrough in accordance with ramjet principles, said cannon including a barrel having a bore extending therethrough, a breech end and a muzzle end, and means for sealing said barrel ends, wherein said projectile traveling through said barrel compresses a fuel-oxidizer mixer contained therein, gas generated by the combustion of said compressed mixture accelerating said projectile through said barrel, said projectile comprising:

an essentially conically shaped body with an essentially flat base, configured relative to said barrel for providing supersonic compression and combustion of said fuel-oxidizer mixture, said conically shaped body producing a covergent subsonic wake as it travels through said barrel, said wake stabilizing the supersonic combustion process by spreading the combustion gases over the diverging region surrounding the wake, moderating pressures within the barrel, such that the compression and combustion pressures are essentially matchable to the barrel limiting pressure, thereby maximizing projectile acceleration.

7. The projectile of claim 6 configured, relative to said barrel, for providing supersonic compression, with an aerodynamic contraction ratio of from 0.05–0.50.

8. The projectile of claim 7 configured, relative to said barrel, for providing supersonic compression with an aerodynamic contraction ratio of 0.25.

9. The projectile of claim 6 having an optimally balanced center of gravity to provide stabilized flight at supersonic speeds.

* * * * *